United States Patent [19]

Robertson

[11] 4,197,702

[45] Apr. 15, 1980

[54] ROTOR SUPPORT STRUCTURE FOR A GAS TURBINE ENGINE

[75] Inventor: John M. Robertson, Derby, England

[73] Assignee: Rolls-Royce Limited, London, England

[21] Appl. No.: 907,317

[22] Filed: May 18, 1978

[30] Foreign Application Priority Data

May 26, 1977 [GB] United Kingdom ..... 22195/77

[51] Int. Cl.[2] ..... F02K 3/02; F01D 25/16

[52] U.S. Cl. ..... 60/262; 415/170 R

[58] Field of Search ..... 415/142, 170 R; 60/39.08, 39.31, 226 R, 262

[56] References Cited

U.S. PATENT DOCUMENTS

| | | | |
|---|---|---|---|
| 2,410,450 | 11/1946 | Kroon | 415/170 R |
| 2,933,893 | 4/1960 | Blyth et al. | 415/170 R |
| 2,938,336 | 5/1960 | Peterson | 60/39.31 |
| 2,941,781 | 6/1960 | Boyum | 60/39.31 |
| 3,830,058 | 8/1974 | Ainsworth | 60/39.31 |

*Primary Examiner*—John J. Vrablik

*Attorney, Agent, or Firm*—Cushman, Darby & Cushman

[57] ABSTRACT

A rotor support structure for a gas turbine engine comprises a rolling element bearing adapted to carry the rotor, a structurally strong ring adapted to carry the rolling element bearing, and two pairs of supporting struts for the ring, extending substantially tangentially from the ring, each pair joining at a mounting, the two mountings being diametrically opposed with respect to the ring.

7 Claims, 3 Drawing Figures

ROTOR SUPPORT STRUCTURE FOR A GAS TURBINE ENGINE

This invention relates to a rotor support structure for a gas turbine engine.

It has been common practice in the past to support the rotors of gas turbine engines by way of a bearing carried in a bearing panel or series of struts from an outer casing of the engine which is made strong enough to carry loads from the bearing to the engine mountings. This can lead to the casing distorting due to these loads and may produce undesirable variation in clearances etc.

The present invention provides a structure in which the bearing support is carried directly from discrete mounting features.

According to the present invention a rotor support structure for a gas turbine engine comprises a rolling element bearing adapted to carry the rotor, a structurally strong ring adapted to carry the rolling element bearing and two pairs of supporting struts for the ring extending substantially tangentially from the ring, each pair joining at a mounting, the two mountings being diametrically opposed with respect to the ring.

Preferably the mountings are equi-spaced from the bearing axis, and they may be formed in a casing of the engine.

Conveniently the mountings are trunnion mountings and form part of the main mounting of the engine in its supporting structure.

The supporting struts would normally need to extend across the gas flow annulus of the engine, in which case they may be protected from the gas flow by streamlined casings, which may themselves form part of the supporting structure for the stators associated with the rotor.

Thus the streamlined casings may be carried from the structurally strong ring.

Figure 1:
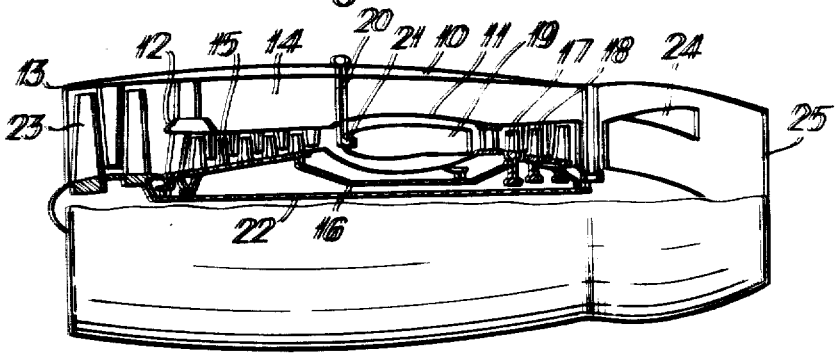
Figure 2:
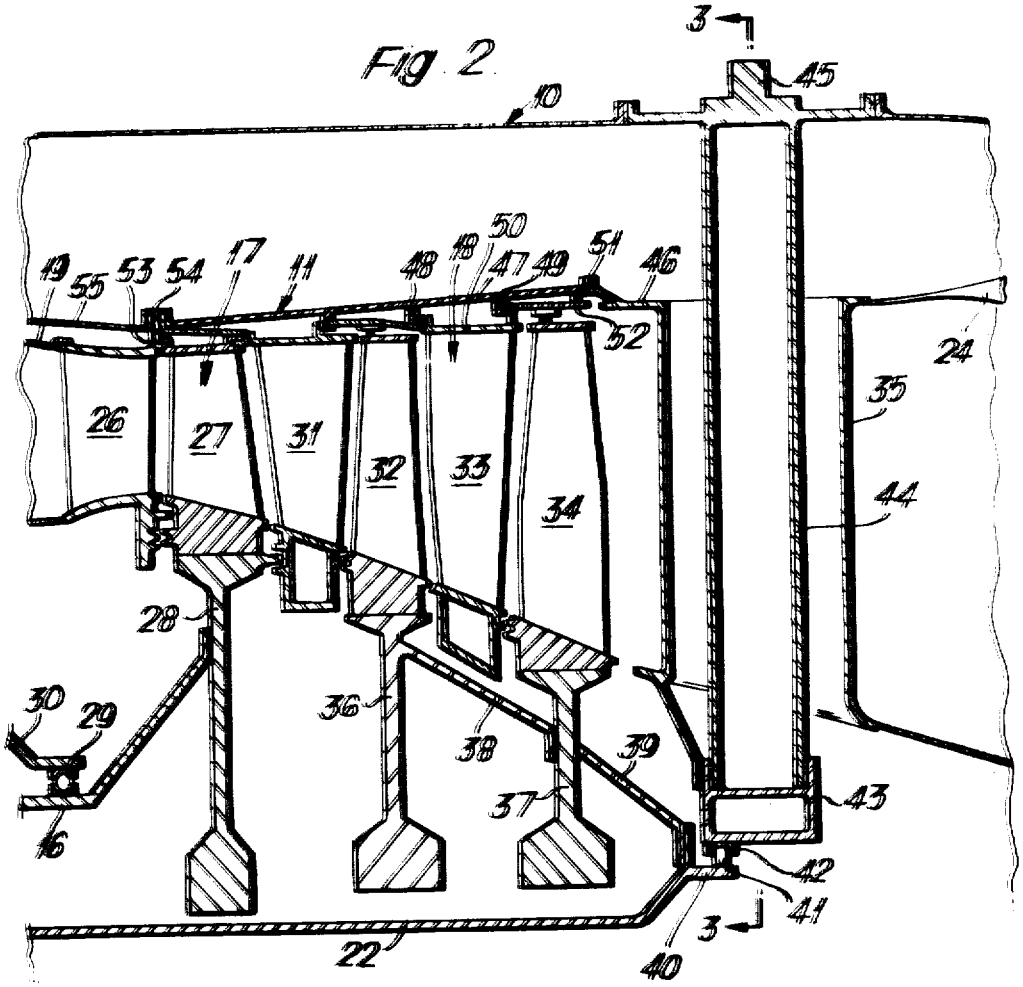
Figure 3:
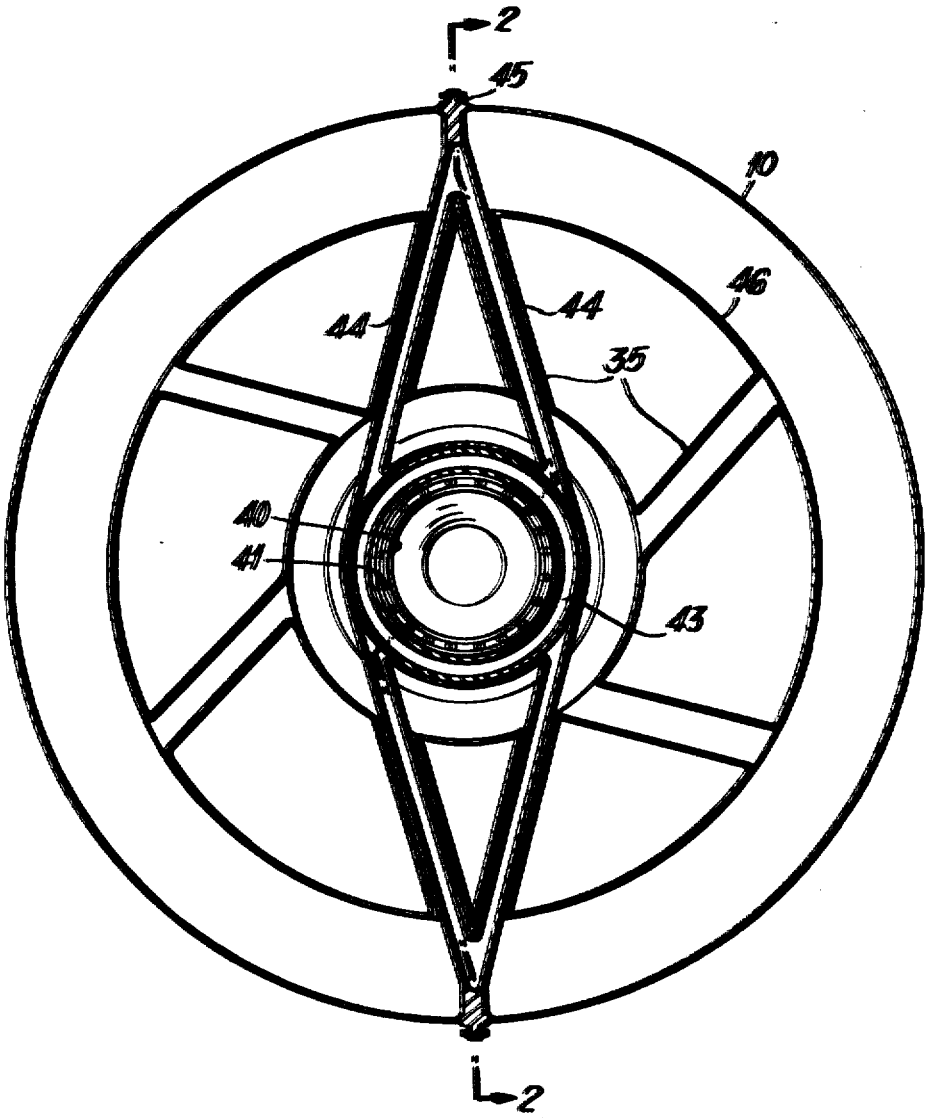

The invention will now be particularly described merely by way of example with reference to the accompanying drawings in which:

FIG. 1 is a partly-sectioned view of a gas turbine engine having turbine rotor support structure in accordance with the invention, FIG. 2 is an enlarged axial section of the turbine rotor support structure of FIG. 1, and FIG. 3 is a transverse section on the line 3—3 of FIG. 2.

In FIG. 1 there is shown a gas turbine engine of the by-pass type, comprising an outer or by-pass casing 10 and a concentric inner or core casing 11, the core casing having its entry 12 downstream of the entry 13 to the outer casing, and the annular space 14 between the casings comprising a by-pass air passage. Inside the inner casing 11 are mounted in flow series for rotation about the engine axis a high pressure compressor 15 drivingly connected by a hollow shaft 16 with a high pressure turbine 17, and a low pressure turbine 18. A combustion chamber 19 lies between the compressor 15 and turbine 17 and in operation this chamber accepts compressed air from the compressor 15, mixes it with fuel supplied by the feed arms 20 and burners 21, and burns the resulting mixture. Hot gases from the chamber drive in sequence the high pressure turbine 17 and thus the compressor 15, and the low pressure turbine 18.

The low pressure turbine 18 drives a shaft 22 mounted concentrically within the shaft 16 and hence the low pressure compressor 23. This compressor is mounted upstream of the inner casing 11 and occupies the whole section of that part of the fan duct 10 which extends upstream of the casing 11. Thus the low pressure compressor 23 takes in air from the entry to the casing 10 and compresses this air, part of which flows in the by-pass passage 14 and part of which forms the feed air to the high pressure compressor 15. The by-pass air on reaching the outlet end of the passage 14 is mixed by a series of corrugations 24 formed on the downstream end of the casing 11 with the hot gases exhausting from the turbine 18. The mixed flow then passes to atmosphere via a propulsion nozzle 25.

FIG. 2 shows enlarged and in greater detail the general area of the turbines. It should be noted that the view of FIG. 2 is not a true plane section; the right-hand part of the section has been arranged to show internal details which would not be visible in a true sectional view.

In FIG. 2 can be seen the downstream end portion of the combustion chamber 19 and the nozzle guide vanes 26 which direct the hot gases from the turbine onto the single stage of rotor blades 27 which comprise the high pressure turbine 17. The blades 27 are in turn carried from a rotor disc 28 which drives the shaft 16; a bearing 29 and panel 30 in turn carry the shaft 16 from fixed structure of the engine. After leaving the rotor stage 27 the gases flow through a stage of static vanes 31 and act on the first rotor stage 32 of the two stage low pressure turbine 18. They then flow through a further stage of static vanes 33 and act on the second rotor stage 34 of this turbine. The spent gases then flow in between the streamlined struts 35 whose purpose is described below, and are mixed by the corrugations 24 with the by-pass flow.

In similar fashion to the high pressure turbine 17 described above, the rotor stages 32 and 34 of the low pressure turbine are carried from respective rotor discs 36 and 37. These discs are drivingly interconnected through a frusto-conical stub shaft 38, and the downstream disc 37 is connected to the shaft 22 by a further frusto-conical stub shaft 39. At the joint between the shaft 22 and stub shaft 39 a flange 40 from the shaft 22 has a cylindrical outer surface and forms the inner race of a roller bearing, the rolling elements 41 of which run between the flange 40 and an outer race 42 which is held in a structurally strong ring 43 of rectangular hollow section. The bearing formed by the flange or inner race 40, rolling elements 41 and outer race 42 thus forms the support for the rotor of the low pressure turbine 18.

The strong ring 43 is itself carried directly from the outer casing 10 of the engine by load-carrying struts 44. As can best be seen from FIG. 3 there are four of these struts extending in pairs from two diametrically opposed mounting spigots 45 on the casing 10 to join the ring 43 substantially tangentially. The struts of each pair form the two substantial tangents to the ring 43 from the respective spigot 45. (It will be noted that in order to show the struts 44 in FIG. 2, it has been necessary to depart from a true section). These struts 44 thus form a positive location of the ring 43 directly from the spigots 45 which form part of the mounting structure of the engine in its respective aircraft.

Surrounding each of the load-carrying struts 44 is one of the hollow streamlined struts 35. As can best be seen from FIG. 3 these streamlined struts 35 comprise equi-spaced struts extending approximately tangential to the ring 43, two of which surround the two load-carrying struts 44 which are canted in the same sense as that of those six struts 35, and a further pair of struts 35 each of which surrounds one of the two struts 44 canted in the opposite direction. It will be understood that the six struts canted in the same direction comprise a well-known expedient for taking up differential expansion between a hub, a set of struts, and a surrounding casing, the tangential disposition of the struts allowing such differential expansions to be accommodated by relative rotation between the hub and casing.

However, because the pair of struts 35 canted in the opposite direction would normally oppose such rotation it is necessary to provide some expedient to allow these two struts to change their length by a small amount. This is not shown in the drawings but could comprise a sliding joint or a corrugated portion.

At their outer extremities the struts 35 are attached to a shroud ring 46, and this shroud ring is therefore rigidly supported via the struts 35 from the strong ring 43. At its forward extremity the ring 46 is attached to and carries a frusto-conical casing member 47 which in turn carries the two stator stages 31 and 33 and the associated stationary shroud structure. The detailed structure which supports all these features will not be described in detail since it is not fundamental to the present invention, however in the case of the stage 33 it will be seen that pairs of grooved flanges 48 and 49 support the outer shrouds 50 of the stator blades while the flange 49 and the engagement 51 between the casing shroud 46 and the casing member 47 supports a static shroud ring 52. Similar engagements support the other stator blades and stationary shrouds.

At its forward edge the casing member 47 is connected by a flange engagement 54 to the mounting projection 53 of the nozzle guide vanes 26 and to a further forwardly extending casing member 55.

It will therefore be seen that the function of supporting the stator blades of the stages 31 and 33 and the static shroud structure of the rotor stages 27, 32 and 34 is carried out by the casing 47 whose loads are taken into the shroud 46 and through the struts 35 into the structurally strong ring 43. The support of this static structure does not therefore have to carry any of the bearing loads from the various rotors, these loads being separately taken directly into the ring 43. The combined rotor loads and static structure loads are carried from the spigots 45 by way of the load carrying struts 44 through a load path separate from that by which the static structure is supported from the ring 43. In this way there are no external loads on this static structure which might tend to distort it and it is therefore possible to reduce the clearances between the rotor blades and the static structure to a small value without the danger of distortions of the static structure causing seal rubs or other undesirable contacts between static and rotating structure.

It should be appreciated that it would be possible to envisage other applications of the rotor support structure of the invention. Thus the other bearings of the other rotors of the engine could be supported by the ring and tangential struts. Although in most cases the mounting spigots 45 will be integral with or attached to the cylindrical casing 10, this is not essential. Thus it is possible that the mountings at the extremities of the two pairs of struts could be at different radial distances from the rotor axis, and thus at least one of the mountings would be separate from the casing.

I claim:

1. A by-pass gas turbine engine having a core engine with compressor means, combustion means, and turbine means in flow series, said gas turbine engine comprising:

a fixed outer casing and a concentrically arranged fixed inner casing means defining a by-pass passage therebetween, said inner casing means also defining outer bounds for the gas flow annulus through the core engine;

a rotor carried within said inner casing means and supporting a plurality of rotor blades, said rotor defining a portion of inner bounds for the gas flow annulus through the core engine;

a rotor support structure for rotatably carrying said rotor operatively from said fixed outer casing, said rotor support structure comprising two pairs of supporting struts extending through the gas flow annulus of said core engine and through the by-pass passage, a pair of diametrically opposed mountings, each operatively carried by said outer casing and each being connected to one of said pairs of supporting struts, an annular structurally strong ring connected to said two pairs of supporting struts with each supporting strut of each of said pairs extending substantially tangentially from said ring, and a rolling element bearing supporting said rotor and positioned between said ring and said rotor;

stator blades associated with said rotor;

and stator support structure forming part of said inner casing means and fixedly secured to and supported by said ring, said support structure carrying said stator blades, and said stator support structure including streamlined casings encasing each support strut of each of said pairs of support struts to protect the support struts from gas flow in the gas flow annulus of the core engine.

2. A gas turbine engine as claimed in claim 1 and in which there is supporting structure from which said engine is mounted, said mountings forming part of the main mounting of the engine from the supporting structure.

3. A gas turbine engine as claimed in claim 1 including a fixed shroud surrounding said rotor blades, said fixed shroud being carried by said stator support structure.

4. A gas turbine engine as claimed in claim 1 and in which said mountings are equi-spaced from an axis of said rolling element bearing.

5. A gas turbine engine as claimed in claim 4 and in which said mountings are formed as part of said outer casing.

6. A gas turbine engine as claimed in claim 1 in which said structurally strong ring is rectangular and hollow in radial section.

7. A gas turbine engine as claimed in claim 6 in which said rolling element bearing includes an outer race fixed to said ring, an inner race defined by an annular flange fixed to said rotor and rolling elements therebetween.

* * * * *